US005704689A

United States Patent [19]

Kim

[11] Patent Number: 5,704,689

[45] Date of Patent: Jan. 6, 1998

[54] CHAIR HAVING SEPARABLE BACK

[76] Inventor: Moung Sook Kim, 397-4 Yangjae-Dong, Seoul, Rep. of Korea

[21] Appl. No.: 727,646

[22] PCT Filed: Feb. 13, 1996

[86] PCT No.: PCT/KR96/00021

§ 371 Date: Oct. 15, 1996

§ 102(e) Date: Oct. 15, 1996

[87] PCT Pub. No.: WO96/25072

PCT Pub. Date: Aug. 22, 1996

[30] Foreign Application Priority Data

Feb. 15, 1995 [KR] Rep. of Korea ..... 1995-2750

[51] Int. Cl.[6] ..... A47C 3/00

[52] U.S. Cl. ..... 297/301.4; 297/303.5

[58] Field of Search ..... 297/301.1, 301.3, 297/361.1, 284.1, 284.3, 284.4, 301.4, 303.5

[56] References Cited

U.S. PATENT DOCUMENTS

| | | | |
|---|---|---|---|
| 180,548 | 8/1876 | Chichester | 297/284.4 |
| 233,140 | 10/1880 | Candrian | 297/284.4 |
| 2,547,455 | 4/1951 | Freeman | 297/303.5 X |
| 2,558,171 | 6/1951 | Chesley | 297/284.4 X |
| 4,641,884 | 2/1987 | Miyashita et al. | 297/284.3 X |
| 5,058,953 | 10/1991 | Takagi et al. | 297/284.4 |
| 5,062,676 | 11/1991 | Mars | 297/284.3 X |
| 5,120,109 | 6/1992 | Rangoni | 297/284.3 |
| 5,370,443 | 12/1994 | Maruyama | 297/284.1 |
| 5,385,388 | 1/1995 | Faiks et al. | 297/284.4 X |
| 5,447,357 | 9/1995 | Snijders | 297/284.3 |
| 5,501,507 | 3/1996 | Hummitzsch | 297/284.4 |

FOREIGN PATENT DOCUMENTS 59-34622 3/1984 Japan .

*Primary Examiner*—Milton Nelson, Jr.

*Attorney, Agent, or Firm*—Jacobson, Price, Holman & Stern, PLLC

[57] ABSTRACT

The back of a chair is divided into a waist support (40) and a shoulder support (50) which are pivotally supported by respective support members (27 and 37) so that they can move freely and individually. The waist support (40) and the shoulder support (50) can move back and forth freely and independently against resilient resistance and their inclinations can be adjusted separately and manually. The waist support (40) always supports the waist while keeping close contact therewith and the shoulder support (50) supports the shoulder while keeping close contact therewith. Therefore, even when one uses the chair for a long time, the occupants comfort is assured as no load is applied to the waist.

3 Claims, 3 Drawing Sheets

CHAIR HAVING SEPARABLE BACK

BACKGROUND OF THE INVENTION

1. Field of the Invention

The present invention relates to a comfortable chair for a chair occupant even though seated in the chair for long time periods. The chair includes a back support divided into a separate and independently controlled waist support and shoulder support. The waist support supports the waist and the shoulder support supports the shoulders simultaneously and individually.

2. Description of the Related Art

In general, in order to provide a comfortable chair, it is necessary to support a person's backbone inclination or adjust the back support inclination to a person's posture. Typically, there are two methods of adjusting a back support's inclination, one is that a back support is moved back while maintaining elasticity or resilient resistance as one who is seated puts force upon it and the other is that one seated manually controls the inclination of the back support.

However, there is a problem of controlling the inclination of a portion supporting a waist and shoulder respectively because the back support is composed of one body.

Backbone inclinations and seat postures vary substantially. If the back support is composed of one body, if a waist is to be supported against a chair back, a shoulder is not supported, or if a shoulder is to be supported against a chair back, a waist is not supported. Therefore, there is a problem of decreasing the efficiency of work because of feeling fatigued from using a chair during long hours.

SUMMARY OF THE INVENTION

Accordingly, it is an object of the present invention to provide a chair having a back support which includes a separate waist support and shoulder support which can be used without feeling fatigued during long hours because the waist and shoulders of one seated are simultaneously and individually supported without respect to the backbone inclination and seat posture of one seated.

To achieve the above object, the present invention provides a back support of a chair divided into a waist support for supporting a waist, a shoulder support for supporting a shoulder, a waist support member and a shoulder support member constructed so that the waist support and shoulder support can be separately moved.

In a conventional chair in which the back support is moved back against resilient resistance as one seated applies force against the back support, the conventional back support is constructed of one body. The back support is connected to a hinge shaft under a chair seat plate by means of support members composed of one or two coil springs coupled to the support members. Therefore, the back support is moved back against resilient resistance of the support members which can be adjusted by control knobs engaging the coil spring or springs.

However, in one embodiment of the present invention, a back support is divided into a waist support and shoulder support, which are directly coupled to a seat plate by means of respective different support members and a hinge shaft. The waist support and shoulder support are pivotally movable about the hinge shaft with such movement being controlled by a resilient structure in the form of a coil spring adjustably connecting the seat plate and the respective support members. Therefore, the respective support members are independently resiliently controlled and a control knob is installed to control the elastic force exerted by each coil spring.

In a second embodiment of a chair having a back support separated in accordance with the present invention, a back support is divided into a waist support and shoulder support, the waist support is coupled to a hinge shaft under a chair seat plate by waist support members, a shoulder support is coupled to a hinge shaft installed at the upper end of the waist support by shoulder support members, an elastic material of springs is installed so that the waist and shoulder support members can have elasticity. Therefore, the waist and shoulder support are pulled back against the elastic force respectively. In this embodiment of the invention, the back support is divided into a waist support and shoulder support and inclination controllers are installed on both sides of a seat plate as compared with the conventional inclination controller fixed on only one side of the seat plate.

In another aspect of the second embodiment of the present invention, a back support is divided into a waist and shoulder support, one of two waist support members is coupled to a connector of an inclination controller installed on one side of a seat plate, the other is coupled to a connector by installing a hinge shaft between the seat plate and waist support, one of two shoulder support members is coupled to the connector of the inclination controller by installing the inclination controller at an upper of one side of the waist support, the other is coupled by installing a hinge shaft between the waist and shoulder support. Therefore, the inclination of the waist support is controlled by a handle of the inclination controller installed on one side of the seat plate and the inclination of the shoulder support is controlled by a handle of the inclination controller installed on the side of the waist support.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
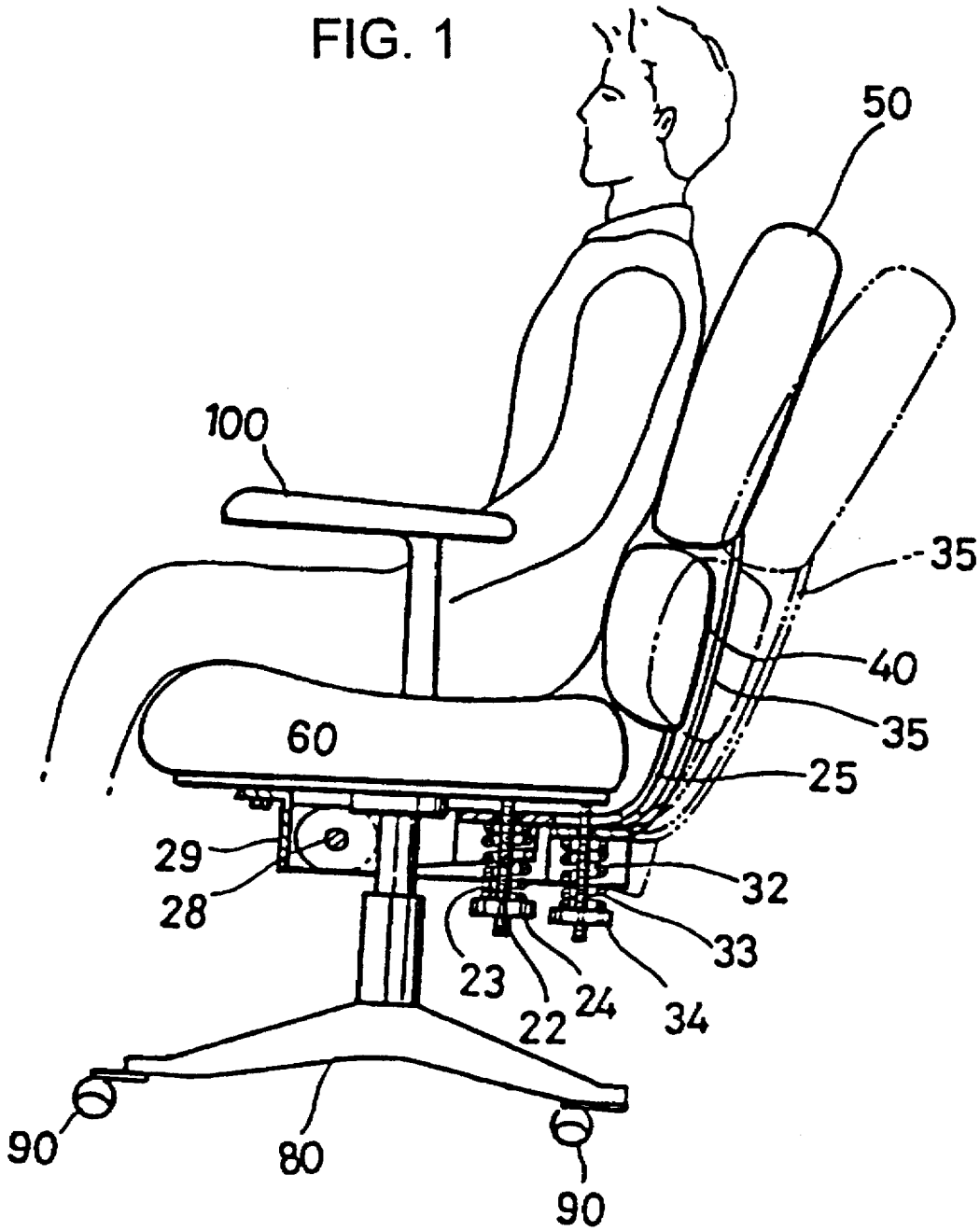
FIG. 1 is a side elevational view, partially in section, of a first embodiment of the present invention.
Figure 2:
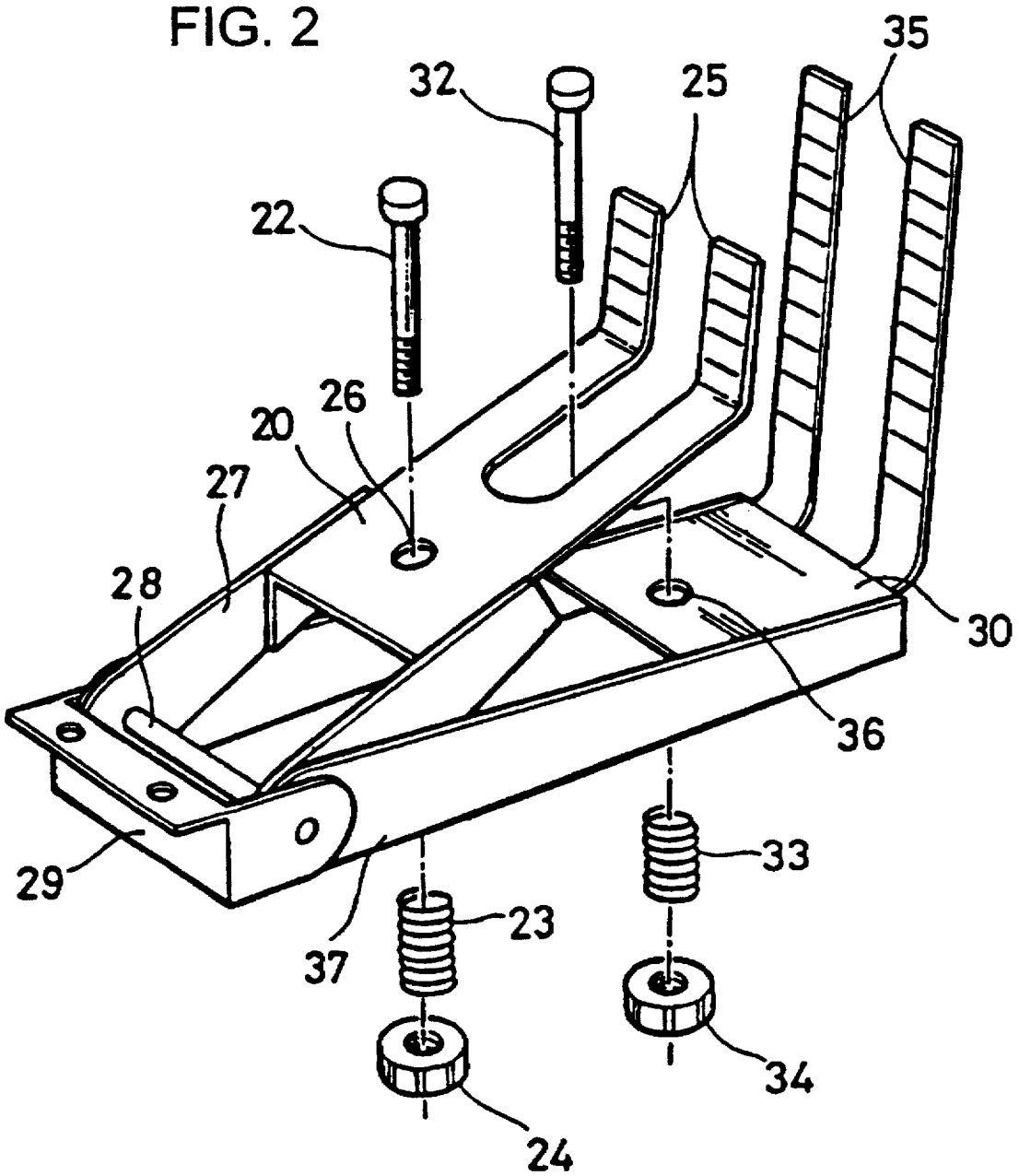
FIG. 2 is a perspective view of the support members and related structure used in FIG. 1.

A first embodiment of the present invention is illustrated in FIGS. 1 and 2 of the drawings and includes a back support of a chair divided into a waist support 40 supported from waist support members 27 and a shoulder support 50 supported from shoulder support members 37. The waist support members 27 and shoulder support members 37 are coupled at their forward ends to a hinge shaft 28 and a bracket 29 secured under the forward end of a seat plate 60. Threaded shafts 22, 32 are vertically fixed under the chair seat plate 60 and extend through holes 26, 36 in horizontal plates 20, 30 rigid with the support members 27 and 37. Coil springs 23, 33 are mounted on the threaded shafts 22 and 32 with their upper ends engaging the bottom surface of the plates 20, 30. Internally threaded knobs 24, 34 are threaded onto the lower ends of shafts 22, 32 to control resiliency of the springs 23, 33.

Horizontal plates 20, 30 of the waist support members 27 and shoulder support members 37 include spaced vertical plates 25, 35 respectively connected to rear portions of the waist support 40 and shoulder support 50. The waist support 40 and shoulder support 50 simultaneously support a waist and shoulders of a chair occupant and both supports 40, 50 can move rearwardly as shown in broken line in FIG. 1 against the elasticity of springs 23, 33. The resistance to such movement as the seat occupant applies force on the supports 40, 50 is controlled through control knobs 24, 34.

Since vertical plates 35 of shoulder support members 37 are spaced rearwardly of the waist support 40, the waist support 40 can be moved rearwardly inasmuch as a chair occupant moves their waist and shoulders simultaneously to position their pelvis on the seat plate. The force exerted by a waist of an occupant is usually less than the force exerted by the shoulders. Therefore, the vertical plates 35 of the shoulder support members 37 do not prevent operation of the waist support 40. If desired, the coil springs 23, 33 can be replaced by other elastic devices such as other type springs or torsion bars. Other parts of a conventional chair illustrated in FIG. 1 include a chair leg 80, wheels 90 and armrests 100.

Figure 3:
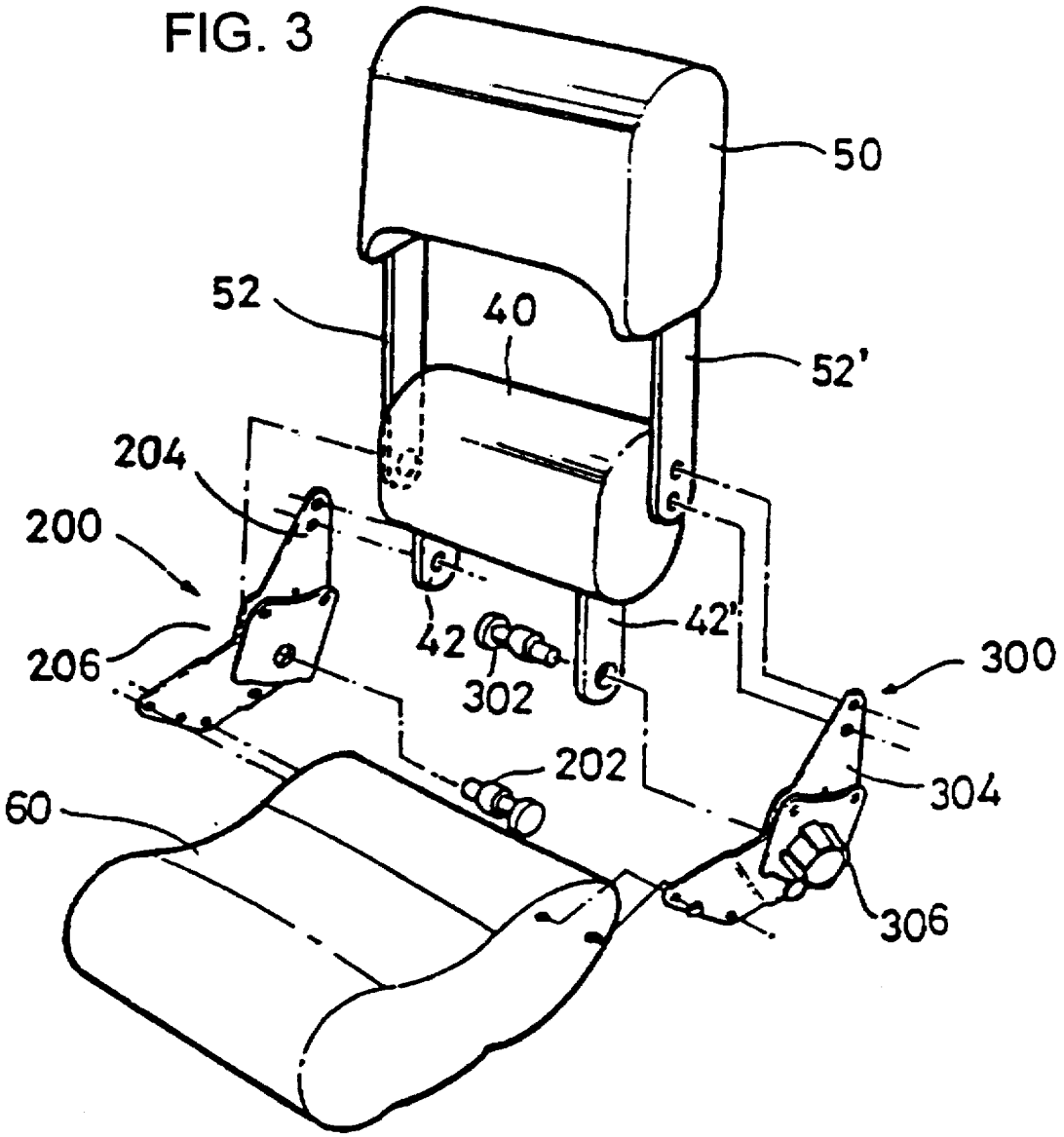
FIG. 3 is an exploded perspective view of a second embodiment of the present invention.

FIG. 3 illustrates a second embodiment of the present invention applied to a chair in which inclination of a back support is manually controlled.

Referring to FIG. 3, a back support of a chair divided into a waist support 40 supported from waist support members 42, 42' and a shoulder support 50 supported from shoulder support members 52, 52'. The respective support members 42, 42', 52, 52' are coupled with inclination controllers 200, 300 connected to the support members and fixed to the sides of a conventional seat plate 60.

In a conventional chair in which inclination of a back support is manually controlled, the back support has one back support member and two branched support members which extend to the right and left and one is coupled to a support member connector of the inclination controller fixed on one side of the chair seat plate, the other branched support member is coupled to a hinge shaft between a seat plate and back support. As a result, it was possible manually to control the inclination of the back support by using a handle fixed on one inclination controller.

However, since the back support of the second embodiment of the present invention is divided into a waist support 40 and shoulder support 50, and the respective supports have left-right waist support members 42, 42' and left-right shoulder support members 52, 52', the inclination controllers 200, 300 are respectively installed on right-left sides of the seat plate 60. Shoulder support member 52' is coupled to a support connector 304 of the inclination controller 300. Support member 42' is coupled to connector 304 by a shaft 302. The support member 42 is coupled to a support connector 204 of the controller 200. Support member 52 is coupled to support connector 204 by a shaft 202 of the controller. As a result, the inclination of the shoulder support members 52, 52' is controlled by inclination controller handle 306 at one side of the seat plate and the inclination of the waist support members 42, 42' is controlled by controller handle 206 at the other side of the seat plate 60.

Accordingly, since the waist support 40 and the shoulder support 50 have support members 42, 42', 52, 52', respectively, which can manually control the inclination, an occupant seated in the chair can manually control the inclination of the waist support members 42, 42' and shoulder support members 52, 52' to conform with the inclination of their backbone to maintain a desired posture. Therefore, the waist support 40 and shoulder support 50 can simultaneously support a waist and shoulder.

Even if various seat postures and backbone inclinations are desired by chair occupants, the waist and shoulder support simultaneously and respectively support the waist and shoulder to provide a comfortable chair by manually controlling the respective support members. As a result, a chair occupant is capable of increasing the efficiency of work even though seated for long hours.

It will be apparent to those skilled in the art that various modifications and variations can be made in a chair having a back support of the present invention without departing from the spirit or scope of the invention. Thus, it is intended that the present invention cover the modifications and variations of this invention provided they come within the scope of the appended claims and their equivalents.

What is claimed is:

1. A chair comprising a seat plate and a back support extending upwardly at a rear portion of said seat plate to engage and support a back of a seat occupant, said back support including a waist support engaging and supporting a waist area of the back of the seat occupant and a shoulder support engaging and supporting a shoulder area of the seat occupant, said shoulder support being separate from and independent of said waist support, said shoulder support being located above and generally in alignment with said waist support, a waist support member supporting said waist support, a shoulder support member supporting said shoulder support, said waist support member extending forwardly under said seat plate and terminating in a forward end pivotally connected to said seat plate, said shoulder support member extending forwardly under said seat plate independently of said waist support member, said shoulder support member terminating in a forward end pivotally connected to said plate to enable independent pivotal movement of said support members, and an independent resilient structure connecting said seat plate to each of said support members, each independent resilient structure being independently adjustable to independently control the resilient resistance to pivotal movement of each of the support members, the waist support and the shoulder support.

2. The chair as defined in claim 1 wherein each of said support members includes an upwardly extending plate at a rearward end thereof, said upwardly extending plate on said shoulder support member extending above and being spaced rearwardly from the upwardly extending plate on the waist support member and supportingly connected to said shoulder support, said upwardly extending plate on the waist support member being shorter than and spaced from the upwardly extending plate on said shoulder support member and supportingly connected to said waist support to enable relative pivotal movement between the waist support and shoulder support without interference.

3. The chair as defined in claim 2 wherein each of said resilient structures includes a depending threaded member rigidly connected to said seat plate and extending downwardly through an aperture in one of said support members, a coil spring mounted on each of said threaded members and a threaded knob mounted on a lower end of each threaded member to independently control compressive force on each coil spring thereby independently controlling the resilient resistance to pivotal movement of said shoulder support and said waist support.

* * * * *